US005715795A

United States Patent [19]

Guentert et al.

[11] Patent Number: 5,715,795

[45] Date of Patent: Feb. 10, 1998

[54] FUEL INJECTION APPARATUS FOR INTERNAL COMBUSTION ENGINES

[75] Inventors: Josef Guentert, Gerlingen; Juergen Fritsch, Bechofen, both of Germany

[73] Assignee: Robert Bosch GmbH, Stuttgart, Germany

[21] Appl. No.: 720,159

[22] Filed: Sep. 25, 1996

[30] Foreign Application Priority Data

Sep. 25, 1995 [DE] Germany ..... 195 35 368.4

[51] Int. Cl.[6] ..... F02M 37/04; F02M 41/00

[52] U.S. Cl. ..... 123/467

[58] Field of Search ..... 123/467, 506, 123/510; 137/513.5, 543.23

[56] References Cited

U.S. PATENT DOCUMENTS

| | | | |
|---|---|---|---|
| 4,467,767 | 8/1984 | Kampichler et al. | 123/467 |
| 4,628,957 | 12/1986 | Hofer et al. | 137/513.5 |
| 4,648,369 | 3/1987 | Wannewetsch | 123/467 |
| 5,033,506 | 7/1991 | Boginger et al. | 123/467 |
| 5,390,692 | 2/1995 | Jones et al. | 123/467 |

FOREIGN PATENT DOCUMENTS

| | | | |
|---|---|---|---|
| 0061534 | 10/1982 | European Pat. Off. | 12/467 |
| 3633136/C2 | 4/1988 | Germany . | |
| 0249664 | 12/1985 | Japan | 123/467 |
| 2193262 | 2/1988 | United Kingdom . | |
| 2195708 | 4/1988 | United Kingdom . | |
| 2265943 | 10/1993 | United Kingdom . | |

*Primary Examiner*—Thomas N. Moulis

*Attorney, Agent, or Firm*—Edwin E. Greigg; Ronald E. Greigg

[57] ABSTRACT

A fuel injection apparatus for internal combustion engines, having a fuel injection pump inserted into the housing of the engine. A pump piston, which is driven axially back and forth in a cylinder bore, with one end face defines a pump work chamber from which a short injection line leads to an injection valve, and which can be made to communicate via a feed line with a fuel-filled low-pressure chamber. A magnetic valve disposed on the fuel injection pump controls the high-pressure feeding into the injection line. In order to avert an overly rapid return flow of fluid from the injection line into the pump work chamber, a return flow throttle valve is inserted into the injection line.

18 Claims, 1 Drawing Sheet

FUEL INJECTION APPARATUS FOR INTERNAL COMBUSTION ENGINES

BACKGROUND OF THE INVENTION

The invention is based on a fuel injection apparatus for internal combustion engines. In such a fuel injection apparatus, known from German Patent DE 36 33 136 C2, the pump piston of a fuel injection pump is moved back and forth axially in a cylinder bore by a cam drive. In the process, with its free end face, the pump piston defines a pump work chamber in the cylinder bore that can be filled with fuel from a low-pressure chamber via a feed line and communicates via an injection line with an injection valve that protrudes into the combustion chamber of the engine to be supplied. Controlling the high-pressure pumping or injection at the injection valve is done via a magnetic valve, which during the injection phase closes a relief line leading away from the pump work chamber into the low-pressure chamber, so that an injection pressure can build up in the pump work chamber during the pumping stroke of the pump piston.

In the known fuel injection apparatus, the fuel injection pump and the magnetic valve are inserted directly into the engine housing near the injection point and communicate with the injection valve over a short injection line.

However, the known fuel injection apparatus, based on the principle of a pump line nozzle system, has the disadvantage that cavitation damage occurs within the injection line because of the rapid change in pressure of the pressure waves reflected back and forth; this damage can severely shorten the service life of the injection line and thus cause failure of the entire injection apparatus.

OBJECT AND SUMMARY OF THE INVENTION

The fuel injection apparatus for internal combustion engines according to the invention has the advantage over the prior art that by the provision of a return flow throttle valve, which throttles the returning fuel flow from the injection line into the pump work chamber, can reliably avoid an overly rapid drop in the fuel pressure in the injection line and regions of local negative pressure, so that cavitation damage cannot occur in the injection line.

This return flow throttle valve can be inserted directly into the housing of the fuel injection pump or of the magnetic valve; alternatively, it is also possible to provide the return flow throttle valve in a separate component which can then be inserted individually into the injection line, in the form of a cuff or cartridge. This has the advantage of easy accessibility and of the possibility of retrofitting already existing apparatus with a return flow throttle valve.

Because of the insertion into the valve body of the valve member that opens in the direction of the injection valve and of its valve spring and the throttle, the return flow throttle valve is highly compact and resistant to high pressure, so that it requires only slight installation space on the fuel injection pump. Moreover, the return flow throttle valve can be economically manufactured in only a few operations; the through opening, with its conical inlet and the serration on the valve body, are already machined in during the original forming operation and thus reinforce a denser fiber course in the valve body, which in turn reinforces high strength in the region of the connection neck at the serration and in the middle region. It is especially advantageous that the valve body has very high strength in the upper and middle region of its longitudinal extent and a lower strength value in its lower region, since an axially protruding biting edge is provided on the lower end, by way of which the valve body is meant to be sealed off in the receiving bore; to that end, the biting edge is intended to deform plastically during the axial bracing of the valve body against a stop in the receiving bore.

The valve body is advantageously fastened by means of a thread on its circumferential face in the receiving bore, and the serration profile on the valve body enables easy tool access; the production of the serrated profile during the original shaping has the advantage that no undercut for a tool exit is necessary, and so the entire surface can be used for a screwdriving tool.

Securing the injection line to the return flow throttle valve is done via a union nut, which engages an annular shoulder of the injection line and is screwed onto a thread on the housing of the pump or of the connecting cuff.

To avoid natural oscillation of the valve member or valve spring, the valve spring is moreover advantageously wound progressively.

To keep wear of the moving valve member of the return flow throttle valve low, this valve can also be made of a more wear-proof material than the valve seat.

Further advantages and advantageous embodiments of the subject of the invention can be learned from the drawing, specification and claims.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
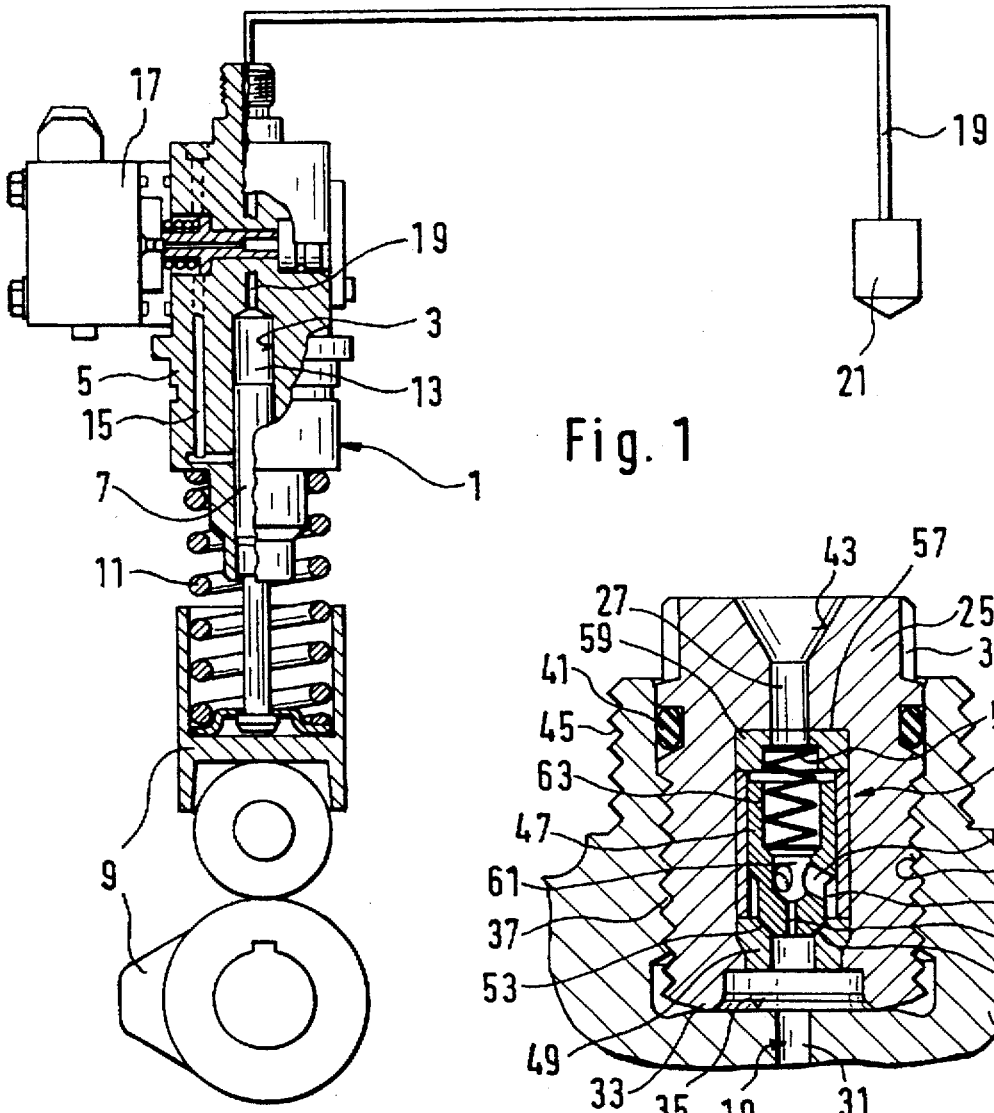
FIG. 1 is a sectional view of the fuel injection apparatus.

The fuel injection apparatus for internal combustion engines, of which FIG. 1 shows only its components essential to the invention, has a fuel injection pump 1 with a pump piston 7 which is guided in a cylinder bore 3 in the pump housing 5 and is driven axially back and forth by a cam drive 9 counter to the force of a restoring spring 11; with its end face remote from the cam drive 9, the pump piston 7 defines a pump work chamber 13 in the cylinder bore 3. This pump work chamber 13 can be made to communicate via a feed line 15 with a fuel-filled low-pressure chamber, not shown in further detail, whose communication with the pump work chamber 13 can be opened by means of a control valve embodied as a magnetic valve 17.

An injection line portion 19 within the housing 5 leads away from the pump work chamber 13; it is relatively short and discharges via another line portion on its other end into an injection valve 21 that protrudes into the combustion chamber of the engine to be supplied.

The fuel injection pump is inserted, in a manner not shown, directly into the housing of the engine near the injection valve 21.

Figure 2:
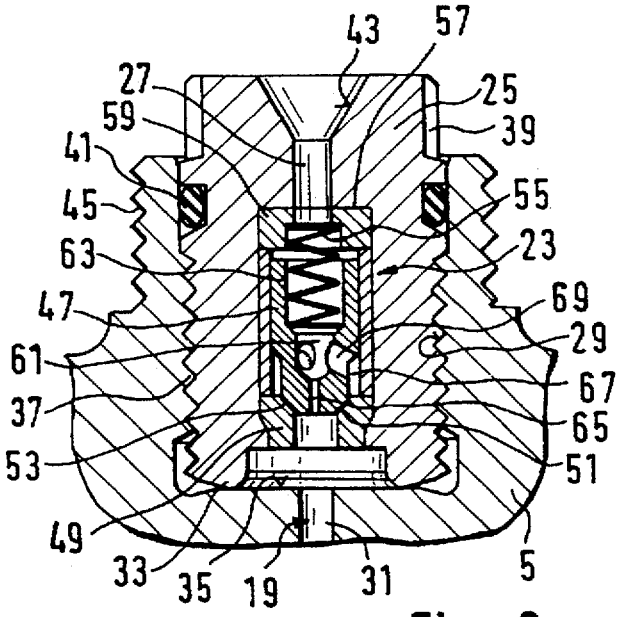
FIG. 2 shows a first exemplary embodiment, in which the return flow throttle valve is inserted into the housing of the injection pump.

To avoid an overly rapid return flow of fuel from the injection valve 21 via the injection line 19 into the pump work chamber 13 at the end of the injection phase, a return flow throttle valve 23 is also inserted into the injection line 19, as close as possible to the pump work chamber 13; in the first exemplary embodiment shown in FIG. 2, it is inserted directly into the housing 5 of the fuel injection pump 1.

For this purpose, the return flow throttle valve 23 has a cylindrical valve body 25 with an axial through opening 27, which is inserted into a receiving bore 29 in the pump housing 5 that is adjoined by a connecting bore 31, forming a part of the injection line 19, that discharges into the pump work chamber 13. The valve body 25, on its lower end face that dips into the receiving bore 29, has an annular, axially protruding biting edge 33, with which it cooperates, sealing off the through opening 27, with a stop face 35 that axially defines the receiving bore 29. The diameter of the through opening 27 is greatly enlarged in the region of the biting edge 33. The valve body 25 is fastened axially in the receiving bore 29 in such a way, by means of a thread 37 provided on its circumferential face, that the biting edge 33 plastically deforms at the stop face 35. To that end, the lower wall region of the valve body 25, near the biting edge 33, has a lesser hardness or strength than the axially middle wall region and an upper wall region, the latter region protruding from the receiving bore 29, of the valve body 25. For the invention of a screwdriving tool, an axial serration 39 is also machined into the upper end of the valve body 25, protruding from the receiving bore 29.

In addition, for sealing between the valve body 25 and the receiving bore 29, a sealing ring 21 is provided, which is guided in an annular groove in the circumferential face of the valve body 25.

The through opening 27, on its upper end located in the region of the serration 39, has an outlet opening 43, which widens conically toward the upper end face of the valve body 25 and which forms a line connection for the injection line 19. In a known manner, not shown in further detail, the injection line 19 is pressed into the outlet opening via a conical neck that is braced axially against the valve body 25 via a union nut, engaging a shoulder of the injection line, that is screwed onto a corresponding screw thread 45 of a tubular extension of the pump housing 5.

The through opening 27 also has a region of widened diameter, in which a pistonlike valve member 47 is axially guided. An annular insert 49 is press-fitted into the lower region of the through opening 27; with its upper annular face, it forms a conical valve seat face 51, which cooperates with a conical valve seat face 53 disposed on the lower end face of the valve member 47. The valve member 47 is pressed by a valve spring 55 into contact with the valve seat 51, counter to the direction of fuel flow to the injection valve 21, and to that end the valve spring 55 is fastened between the valve member 47 and a bore shoulder 57 of the through opening 27. A support ring 59 can be provided on this bore shoulder 57, and the prestressing force of the valve spring 55, which is embodied as a progressively wound helical spring, can be adjusted by way of the thickness of this support ring 59.

The valve spring 55 protrudes into a stepped through bore 61 in the valve member 55, whose larger- diameter region, remote from the valve seat 51, forms a spring chamber 63 that receives the valve spring 55, and whose smaller-diameter region, discharging at the valve sealing face 53, forms a throttle bore 65, by way of which the pump work chamber 13 communicates constantly with the injection line 19.

By means of a shoulder on the valve member 47, an annular chamber 67 is formed between the valve member 47 and the wall of the through opening 27; this annular chamber extends as far as the end of the valve seat 51 remote from the pump work chamber 13, and it communicates constantly with the through bore 61 via a transverse bore 69 in the valve member 47.

Figure 3:
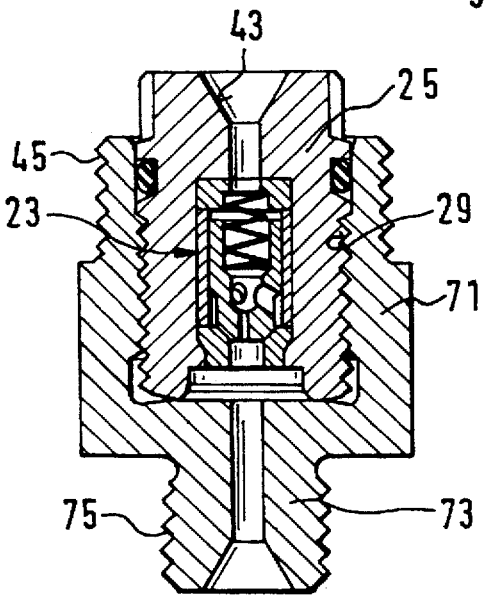
FIG. 3 shows a second exemplary embodiment, in which the return flow throttle valve is disposed in a separate connecting cuff.

The second exemplary embodiment shown in FIG. 3 differs from the first exemplary embodiment of FIG. 2 only in how the return flow throttle valve 23 is received, which is now inserted into a separate tubular connecting cuff 71 that can be freely inserted into the injection line.

To that end, the connecting cuff has a tubular base body, in which the receiving bore 29 is provided, into which bore the valve body 25 is screwed in a manner analogous to FIG. 2. The screw thread 45 for securing the union nut of the injection line 19 is likewise disposed on the circumferential face of the base body of the connecting cuff 71.

On the end remote from the screw thread 45, the connecting cuff 71 has a reduced-diameter connection neck 73, on whose circumferential face a further thread 75 is provided for receiving a further union nut of the injection line 19; in this region, the cross section of the bore in the connecting cuff 71 is likewise conically widened.

The connection neck 73 of the connecting cuff 71 is connected to the injection line portion 19 within the housing 5 and the outlet opening 43 of the return flow throttle valve 23 is connected with the injection line portion 19 connected to the injection valve 21.

The mode of operation of the fuel injection apparatus for internal combustion engines according to the invention is as follows:

During the intake stroke of the pump piston 7 in the direction of bottom dead center, fuel flows via the feed line 15, which is open by the magnetic valve 17, into the pump work chamber 13 and fills the pump work chamber. The valve member 47 of the return flow throttle valve 23 contacts the valve seat 51, so that the injection line portion 19 in the housing 5 communicates with the pump work chamber 13 only via the throttle bore 65.

In the ensuing pumping stroke motion of the pump piston 7 after it passes through bottom dead center, the volume of the pump work chamber 13 shrinks continuously again. With the magnetic valve 17 opened, some of the fuel first flows out of the pump work chamber 13 back into the feed line 15 or alternatively into a bypass line. If the injection is to begin, then the magnetic valve 16 closes this return line, and in the pump work chamber 13, because of the further compression, the injection pressure builds up. After a certain pressure value is reached, the fuel, which is at high pressure, lifts the valve member 47 of the return flow throttle valve 23 away from the valve seat 51, counter to the restoring force of the valve spring 55, so that the fuel flows along this valve seat, via the transverse bore 69, the annular chamber 67, and the through bore 61, into the injection line portion 19 connected with the injection valve 21 reaches the injection valve 21 for injection.

The end of the high-pressure injection is initiated by the reopening of the feed line 15 or a bypass line by the magnetic valve 17, as a consequence of which the high pressure of the fuel in the pump work chamber 13 is very rapidly relieved into the low-pressure chamber. The valve spring 55, because of the pressure drop, rapidly returns the valve member 47 of the return flow throttle valve 23 to contact with the valve seat 51, so that the high pressure located in the injection line 19 can be relieved only via the throttle bore 65 into the pump work chamber 13 and on into the low-pressure chamber. This throttled outflow of fuel from the injection line has the consequence that the pressure there decreases only relatively slowly, so that cavitation damage can be averted.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A fuel injection apparatus for internal combustion engines, comprising a fuel injection pump (1), a housing (5), a cylinder bore (3) in said housing, a pump piston (7) in said cylinder bore, said pump piston (7), is driven axially back and forth in said cylinder bore (3), one end face of said pump piston defines a pump work chamber (13), in said cylinder bore an injection line (19) extends from said work chamber and leads to a fuel injection valve (21), said injection line via said work chamber is made to communicate via a feed line (15) with a fuel-filled low-pressure chamber, and a control valve (17) is disposed on the fuel injection pump (1) and said control valve controls the high-pressure fuel feeding into the injection line (19), a return flow throttle valve (23) is inserted into the injection line (19), said return flow throttle valve (23) has a cylindrical valve body (25), inserted into a receiving bore (29), and a through opening (27) in which a valve member (47) is axially guided; the valve member (47) has a through bore (61), whose end having a large diameter, remote from a valve seat (51), forms a spring chamber (63) and whose end near the valve seat (51) has a reduced diameter that forms a throttle (65), a valve spring (55) in said spring chamber (63), said valve spring (55) is fastened between the valve member (47) and a bore shoulder (57) of the through opening (27), said valve spring presses the valve member (47) into contact with the valve seat (51) counter to the fuel flow direction to the injection valve (21).

2. A fuel injection apparatus in accordance with claim 1, in which an upper wall region of the valve body (25) protrudes from the receiving bore (29) and a middle wall region adjoining said upper wall region in the receiving bore (29) have a greater strength than a lower wall region of the valve body (25) resting on an axial stop face (35) in the receiving bore (29) .

3. A fuel injection apparatus in accordance with claim 2, in which the valve body (25) has an axially protruding biting edge (33) on its end face dipped into the receiving bore (29).

4. A fuel injection apparatus in accordance with claim 2, in which the through opening (27) in the valve body (25) has a conical valve seat face (51), which cooperates with a conical sealing face (53) on the valve member (47).

5. A fuel injection apparatus in accordance with claim 1, in which between the valve member (47) and the wall of the through opening (27) of the valve body (25), an annular chamber (67) is provided, said annular chamber (67) adjoins the end of the valve seat (51) remote from the pump work chamber (13) of the injection pump (1) and communicates constantly with the through bore (61) in the valve member (47) via a transverse bore (69) in the valve member (47).

6. A fuel injection apparatus in accordance with claim 1, in which the valve spring (65) is embodied as a progressively wound helical spring.

7. A fuel injection apparatus in accordance with claim 3, in which the cross section of the through opening (27) of the valve body (25) is greatly enlarged on an end near the biting edge (33).

8. A fuel injection apparatus in accordance with claim 1, in which the valve body (25), by means of a thread (37) disposed on a circumference, is screwed into the receiving bore (29).

9. A fuel injection apparatus in accordance with claim 1, in which with an upper end protruding from the receiving bore (29), the valve body (25) forms a line connection in a region (43), and the through opening in said region (43) widens conically in a direction of an upper end face.

10. A fuel injection apparatus in accordance with claim 9, in which the valve body (25), on said upper end that protrudes from the receiving bore (29), has an axial serration (39) on a circumferential face.

11. A fuel injection apparatus in accordance with claim 1, in which the receiving bore (29) receiving the valve body (25) is provided directly in the housing (5) of the fuel injection pump (1).

12. A fuel injection apparatus in accordance with claim 1, in which the receiving bore (29) receiving the valve body (25) is provided directly in the housing of the control valve.

13. A fuel injection apparatus in accordance with claim 1, in which the receiving bore (29) is disposed in a separate component, which is embodied as a tubular connecting cuff (71), which has a connection neck (73) on an end remote from the return flow throttle valve (23).

14. A fuel injection apparatus in accordance with claim 1, in which the material of the valve member (47) of the return flow throttle valve (23) has a greater wear resistance than that of the material of the valve body (25).

15. A fuel injection apparatus in accordance with claim 10, in which the conical outlet opening (43), the through opening (27), and the serrated profile (39) on the valve body (25) are formed in the process of an original shaping of the valve body (25).

16. A fuel injection apparatus in accordance with claim 1, in which the control valve is embodied as a magnetic valve (17).

17. A fuel injection apparatus in accordance with claim 1, in which the fuel injection pump (1) is inserted directly into the housing of the engine.

18. A fuel injection apparatus in accordance with claim 16, in which the fuel injection pump (1) is inserted directly into the housing of the engine.

* * * * *